US005524780A

United States Patent [19]

Krulik et al.

[11] Patent Number: 5,524,780

[45] Date of Patent: Jun. 11, 1996

[54] CONTROL OF REGENERATION OF AMMONIACAL COPPER ETCHANT

[75] Inventors: Gerald A. Krulik, San Clemente, Calif.; Nenad V. Mandich, Homewood, Ill.; Rajwant Singh, Fullerton, Calif.

[73] Assignee: Applied Electroless Concepts Inc., San Clemente, Calif.

[21] Appl. No.: 381,510

[22] Filed: Jan. 31, 1995

[51] Int. Cl.[6] ..... C23F 1/46

[52] U.S. Cl. ..... 216/93; 156/642.1

[58] Field of Search ..... 216/93; 156/642.1; 134/13; 423/127, 627, 629, 32; 75/726

[56] References Cited

U.S. PATENT DOCUMENTS

| | | | |
|---|---|---|---|
| 3,905,827 | 9/1975 | Goffredo et al. | 134/13 |
| 4,058,431 | 11/1977 | Haas | 156/627 |
| 4,082,546 | 4/1978 | Wallace | 75/109 |
| 4,280,887 | 7/1981 | Konstantouros | 204/150 |
| 5,472,618 | 12/1995 | Bolser | 210/719 |

OTHER PUBLICATIONS

Won, C. W. et al. Metall. Trans. B 24B(1) pp. 192–197.

*Primary Examiner*—Robert Kunemund
*Assistant Examiner*—Anita Alanko

[57] ABSTRACT

A method of improved control of recycle of ammoniacal copper etchant which uses metallic aluminum to remove copper without substantially adding undesirable byproducts. The very rapid reaction can be controlled by using a diluent of copper-free etchant, eliminating overheating. The separated copper and aluminum hydroxide sludge are easily filtered from the etchant. The purified etchant is now suitable for chemical adjustment and reuse.

9 Claims, No Drawings

CONTROL OF REGENERATION OF AMMONIACAL COPPER ETCHANT

The present invention relates to a method of recycle of ammoniacal copper etchant which uses metallic aluminum to remove copper without substantially adding undesirable soluble byproducts. The process is fast and efficient, but difficult to control due to reaction speed and evolution of heat. An improved method uses a substantially copper-free ammoniacal etchant as the diluent for the recycle reaction. This allows a slow, controlled reaction of the copper, without overheating the solution. The separated copper and aluminum hydroxide sludge are easily filtered from the etchant. The purified etchant is now suitable for chemical adjustment and reuse.

BACKGROUND OF THE INVENTION

The printed circuit board industry commonly uses ammoniacal alkaline copper etchant to remove unwanted copper from printed circuit boards as part of the fabrication process. The ammoniacal alkaline copper etchant is a mixture of copper ammonium chloride, ammonium chloride, ammonium hydroxide, ammonium carbonate, and small amounts of other materials. The copper ammonium chloride itself is the active etchant when the copper is in the cupric (+2) state. Cupric ammonium chloride attacks and dissolves metallic copper, forming cuprous (+1) ammonium chloride. The cuprous salt is inactive as an etchant material. Cuprous salts are reoxidized to the active etchant or cupric form by atmospheric oxygen.

This etchant is almost universally used in printed circuit board production shops. The etch rate is very fast and the etch solution can hold large amounts of copper. The normal maximum loading of copper is 105–150 grams of copper per liter (14–20 ounces of copper per gallon). The solution, once loaded with copper, is not discarded. It is recycled and processed to remove the excess copper to yield fresh etchant and metallic copper.

The process which is used for ammoniacal copper etchant regeneration in commercial recycling plants is complex and expensive. The spent etchant is contacted with a liquid ion exchange (LIX) material which is dissolved in a water immiscible organic solvent such as kerosene. This is normally a continuous process using countercurrent flow apparatus. The copper-loaded LIX/kerosene mixture is contacted with a sulfuric acid solution, also using countercurrent flow apparatus. The sulfuric acid extracts the copper from the LIX/kerosene mixture to regenerate the ion exchange material. The copper sulfate/sulfuric acid solution is used to produce low value copper sulfate crystals. Alternatively, the copper sulfate/sulfuric acid solution can be electrolyzed in an electrolytic plating cell to recover higher value metallic copper.

The amounts of spent alkaline etchant produced are very large. Typically one gallon of spent etchant is produced for every 7 to 10 square feet of double sided printed circuit material processed. Even a moderately large shop can produce over one hundred thousand gallons of spent etchant per year. Because the quantities of used ammoniacal etchant are very large and reclaim is very complicated, the used etchant is shipped off-site to recycling facilities. These large shipments of etchant are expensive and hazardous, affording numerous opportunities for hazardous materials spills.

Commercial alkaline etchant recycling facilities are very large and complex. They have multiple large countercurrent extraction flow towers containing large volumes of recirculating etchant, kerosene, hazardous organic complexing agents, sulfuric acid, and copper sulfate. All of these materials are toxic and hazardous in the event of a plant accident and chemical spill. The kerosene solution is also combustible and presents a continuous fire hazard. If copper reclaim is done by electroplating, very large rectifiers with high power consumption are needed.

Another known process for ammoniacal etchant purification uses a special electrolytic cell attached to the etch machine to remove the copper. This has stringent technical and chemical design limits. A two cell process with a membrane separator is often used. Direct electrolysis of ammoniacal copper etchant is not practical due to the presence of chloride, which gives chlorine gas on electrolysis. The etchant was chemically changed from a chloride based to a sulfate based system. This uses copper ammonium sulfate instead of copper ammonium chloride as the active, but much slower etchant. The slower etchant was also needed due to design limits on the speed of electrolytic recovery in this in-plant system to maintain the correct copper concentration for reproducible etching. The actual etching rate is about three times slower than with copper chloride based, ammoniacal alkaline copper etchants. Most printed circuit shops are at or near capacity on their ammoniacal etcher, often fully using them two or even three shifts a day. Thus they would have to triple their capital investment in expensive machines to use this process.

A new process has been developed using metallic aluminum to remove the copper in a simple, one step reaction without the introduction of detrimental impurities and without the use of expensive membrane separators and rectifiers. This process is highly exothermic and difficult to control. An improved process using aluminum as the reductant has now been developed, which gives simple control of the copper reduction reaction.

SUMMARY OF THE INVENTION

The present invention relates to an improved method of ammoniacal etchant recycle which is less expensive, less hazardous, and much quicker than either the LIX/electrolytic process or the direct electrolysis process. This novel process utilizes metallic aluminum in a controlled reaction to directly produce both metallic copper and regenerated etchant. The process is suitable for use in relatively small recycle machines and can be used on-site. This can eliminate environmental hazards and costs of shipments of large amounts of hazardous liquids. The original aluminum reduction process was difficult to control, requiring addition of repeated small quantities of aluminum along with solution cooling, in order to keep the solution from heating to boiling and causing precipitation of unreacted salts.

The improved process uses a quantity of substantially copper-free ammoniacal alkaline copper etchant as the diluent and moderator of the copper reduction by aluminum. This gives a slow reaction with less heating, eliminating the hazards and disadvantages of the original process. Since the diluent has substantially the same composition as the copper-laden etchant, only filtration and minor chemical and pH adjustment is needed to reconstitute a working ammoniacal etchant bath.

It is commonly known that a metal of greater electromotive force (EMF) will reduce a metal of lesser electromotive force on contact. Cementation reactions, for example the formation of blister copper, are commonly used in the mining industry whereby acidic dilute copper solution is contacted with scrap iron. Some of the metallic iron dissolves and metallic copper is deposited on the remaining metallic iron.

It is also known that cementation reactions will occur in alkaline solutions. Since many metals have limited solubility in alkaline solution, such alkaline solutions commonly have chelating or complexing agents added to keep the metals in solution. This is the function of the ammonia in ammoniacal copper etchant, to keep the copper soluble.

Cementation reactions have been used to regenerate acidic ferric chloride (and sulfate) etchants used for copper etching. A copper-laden spent ferric chloride solution is contacted with metallic iron or steel. The copper will precipitate out on the metallic iron. Simultaneously some of the metallic iron will dissolve as ferrous chloride. After all the copper is removed, the solution is filtered, diluted with water and acid, and reused. The disadvantage is that the solid iron reductant dissolves in the solution. Thus for each unit of copper cemented out of solution, a chemically equivalent amount of iron dissolves and increases the amount of active etchant. Each time the etchant is regenerated, there is more active etchant. The excess must be disposed of, usually by waste treatment.

By experimentation it was found unexpectedly that cementation of copper ammoniacal etchant can proceed in a useful manner on aluminum metal. One of the key observations is that the cementation of copper onto aluminum must take place more quickly than the remaining cupric ammoniacal chloride etchant can attack the cemented copper. After the initial high copper concentration is reduced to a relatively low level and/or the temperature is reduced below the normal etch operating temperature, the system stops functioning as an effective etchant and the remainder of the copper precipitates out without being redissolved. The amount of aluminum added to the spent etchant should be at least 20% of the stoichiometric amount of aluminum metal required to react with all of the copper in the spent etchant.

This observation would be of little utility for recycling if there were no other benefits. Normally, during the cementation reaction two things occur simultaneously. The soluble metal of lesser EMF is reduced to solid metal by the metallic element of greater EMF. At exactly the same time, the original solid metallic element goes into solution to replace the precipitated metal. If the higher EMF metal were zinc or iron, the two metals would go into solution as soluble zinc ammoniacal chloride or iron ammoniacal chloride. This means that the etchant,though cleaned of copper, would now contain another metal. This other metal would interfere with or prevent copper etching. Even if it did not, it would accumulate in the solution and allow only a small amount of recycling, as the solution would have to be discarded after one or more cementation steps.

Aluminum either as metallic aluminum or aluminum alloys and in the form of granules, lumps, turnings, sheet, foil, or ingots, any of which can function as a regenerant without the limitations discussed above. Ammonia is used as the complexing agent in ammoniacal copper etchant, to maintain high concentrations of copper in solution. It has been shown that this same ammonia will also keep other metals such as iron or zinc, traditional cementation metals, in solution. However, aluminum does not form a complex with ammonia. In fact, ammonia can be used to precipitate aluminum from acidic solution. This means that aluminum can be used not only to cement out the copper, but also to purify itself from the solution. It is this self-purification aspect that is the most unique and useful part of the aluminum recycle process. Aluminum metal dissolves as $Al^{+3}$ ions as the copper is reduced to the metal. The $Al^{+3}$ ions then immediately react with the aqueous alkaline solution to form insoluble aluminum hydroxide. The etch solution thus is regenerated to a substantially pure solution of copper-free and aluminum-free ammoniacal etchant replenisher solution. The purified solution can now be reused as a copper etchant after pH and concentration adjustment. The combined precipitate of cemented copper and aluminum hydroxide can be filtered off and each can be reclaimed separately.

This reaction is highly exothermic when aluminum and copper-laden etchant are mixed together. If sufficient aluminum is added in one step to react with and precipitate all the copper, an uncontrolled reaction occurs with the solution boiling, often to dryness. This process would require the use of large amounts of solution cooling, and preferably also programmed additions of the solid aluminum.

If a sufficient quantity of substantially copper-free etchant is used to dilute the spent etchant, the reaction can now be controlled. The reaction can easily be maintained at the desired process temperature with little or no external cooling while removing most or all of the dissolved copper. The aluminum can be present in the form of a large excess relative to the amount of copper to be removed, eliminating problems with programmed additions of aluminum. This would allow replenishment of the aluminum at infrequent intervals, making the process more commercially attractive.

DETAILED DESCRIPTION OF THE PREFERRED EMBODIMENTS

Although the disclosure hereof is detailed and exact, the process described here is merely illustrative of the invention. Anyone skilled in the art can utilize this concept to develop many procedures in addition to those shown in the examples.

Test solutions were spent ammoniacal copper etchant from a commercial printed circuit shop. This material (Ultra-etch 50, MacDermid, Inc.) is typical of the ammoniacal etchant commercially available. As received, the pH of the spent etchant is 8.2–8.8 with approximately 160–188 grams of copper per liter. Etchant starter solution is substantially identical with used ammoniacal etchant, except for a slightly lower copper concentration of 150 grams per liter. The etchant uses cupric ammoniacal chloride as the active etchant, so etchant starter solution must contain copper. Etchant replenisher solution is substantially free of copper. The material safety data sheet (MSDS) for etchant replenisher lists ammonium chloride, 10–25 weight percent and ammonium hydroxide, 20–40 weight percent; pH 9–10. The replenisher is mixed with used etchant to maintain a given pH, specific gravity, and copper content for useful etching. For this product the pH is 8.2–8.8, working specific gravity is 1.2–1.22, and the copper content of spent etchant is between about 160 and 188 grams per liter. The amount of aluminum added to the spent etchant should be at least 20% of the stoichiometric amount of aluminum metal required to react with all of the copper in the spent etchant. Thus if the spent etchant contained 188 grams of copper per liter, removal of 20% of the copper would give a solution containing 150 grams of copper per liter. This is equivalent to the etchant starter solution. Further removal of copper can be done by reaction with more aluminum, even to a concentration of less than 1 gram of copper per liter.

This specific process can be reversed in order to practically utilize aluminum purification of the etchant. The copper-laden etchant is diluted with a sufficient quantity of substantially copper-free etchant to give an easily controllable solution for copper removal by aluminum. The degree of dilution can be varied over a wide range, in order to control the copper reduction rate, temperature of the process solution, degree of cooling, etc.

In general the amount of substantially copper-free etchant used to dilute the spent etchant should be sufficient to allow easy control of the process. Dilutions of from 1:1 up to 1:50, spent ammoniacal alkaline copper etchant to copper-free ammoniacal copper etchant may be used. Higher dilutions giving less total dissolved copper allow for easier process control. The dilution should be most preferably from 1:2 to 1:25. Any method of cooling for temperature control may be used to keep the solution below the boiling point to minimize the amount of copper which may redissolve, thus increasing the efficiency of utilization of the aluminum. Active temperature control is not absolutely necessary when large dilutions of the spent etchant are used.

The following examples illustrate the process.

EXAMPLE 1

One half liter spent ammoniacal copper etchant was placed in a four liter beaker. This undiluted solution was deep opaque blue. Thirty grams of degreased aluminum metal turnings were added to the solution. There was an induction time of about one minute, during which there seemed to be little reaction. The copper then suddenly started to rapidly plate out on the aluminum metal. The solution began to boil and finally much of the water was driven off as vapor. After the beaker cooled, distilled water was added to dissolve the purified etchant components. The copper, residual aluminum chips, and aluminum hydroxide precipitate were removed from the bulk of the solution by filtration. The filtrate was adjusted to the original 500 ml by further washing and addition of water.

The filtered solution was adjusted to pH of 8.5 with ammonia. It was colorless, showing that substantially all of the copper was removed. Testing showed that the residual copper was less than 2 mg/l and residual aluminum was less that 10 mg/l. This purified solution was mixed with etchant starter solution in a 1:5 ratio and gave normal copper etch rates.

EXAMPLE 2

Ten milliliters of spent ammoniacal copper etchant was placed in a 250 ml beaker. To this solution was added 90 ml of substantially copper-free ammoniacal etchant replenisher. This was a 1:9 ratio of spent to copper-free ammoniacal copper etchant. One gram of aluminum metal granules was added to the solution. There was an induction time of about two minutes, during which there seemed to be little reaction. The copper then slowly plated out on the aluminum metal. The solution heated from 24° C. to 27° C. in 3.5 minutes, then increased to a maximum temperature of 37° C. in a total of 9 minutes. The reaction was allowed to continue for ten minutes, then an additional 1 gram of aluminum granules was added. There was no further temperature increase in an additional ten minutes. The temperature decreased slowly during this period, showing that the copper was substantially removed. The copper, residual aluminum chips, and aluminum hydroxide precipitate were removed from the bulk of the solution by filtration. Analysis gave <10 mg/l of dissolved copper.

EXAMPLE 3

Nine milliliters of spent ammoniacal copper etchant was placed in a 250 ml beaker. To this solution was added 91 ml of substantially copper-free ammoniacal etchant. This was a 1:10 ratio of spent to copper-free ammoniacal copper etchant. The solution temperature was 27° C. to start. A thin aluminum sheet with a total surface area of 43.2 square centimeters was placed in the solution. The temperature slowly increased to 30° C. over a ten minute period as the copper slowly plated out on the aluminum metal. The reaction was then stopped and the filtered solution analyzed. Analysis showed that the copper was reduced from 12 g/l to 10.4 g/l.

EXAMPLE 4

Sixteen milliliters of spent ammoniacal copper etchant was placed in a 250 ml beaker. To this solution was added 84 ml of substantially copper-free ammoniacal etchant. This was about a 1:5 ratio of spent to copper-free ammoniacal copper etchant. The solution was heated to 54° C. to start. A thin aluminum sheet with a total surface area of 43.2 square centimeters was placed in the solution. The temperature slowly increased to 62° C. over a ten minute period as the copper plated out on the aluminum metal. The reaction was then stopped and the filtered solution analyzed. Analysis showed that the copper was reduced from 24 g/l to 7.8 g/l.

EXAMPLE 5

Sixteen milliliters of spent ammoniacal copper etchant was placed in a 250 ml beaker. To this solution was added 84 ml of substantially copper-free ammoniacal etchant. This was about a 1:5 ratio of spent to copper-free ammoniacal copper etchant. The solution was heated to 54° C. to start. A magnetic stir bar was used in the solution to give a high rate of agitation. Thin aluminum sheet with a total surface area of 86.4 square centimeters was placed in the solution. The temperature quickly increased to 72° C. over a five minute period as the copper plated out on the aluminum metal. The temperature gradually decreased to 54° C. during an additional 5 minutes. The reaction was then stopped and the filtered solution analyzed. Analysis showed that the copper was reduced from 24 g/l to 0.00675 g/l.

What is claimed is:

1. A method for the purification of spent ammoniacal alkaline copper etchant containing more than a desired amount of copper in solution which comprises the steps of:

a) Diluting the spent ammoniacal etchant with substantially identical fresh ammoniacal copper etchant containing little or no copper, b) Contacting the diluted spent ammoniacal etchant with at least 20 % of the stoichiometric quantity of aluminum metal to react with and precipitate at least some of the copper in said diluted spent ammoniacal etchant and to form a precipitate of aluminum hydroxide in said diluted spent ammoniacal etchant, c) Allowing the reaction to continue to reduce the amount of copper in said diluted spent ammoniacal etchant, to less than half of the initial amount in the undiluted spent etchant, d) Separating the purified ammoniacal etchant solution from the solid copper and aluminum hydroxide precipitates formed by the same reaction, thereby forming a separated ammoniacal etchant solution, e) Treating said separated ammoniacal etchant solution with suitable additions of an additional solution to reconstitute the pH, specific gravity, and chemical composition, thereby forming an ammoniacal alkaline copper etchant suitable for reuse.

2. A process according to claim 1 wherein said spent ammoniacal copper etchant is diluted with between 0.5 and 50 parts of said fresh ammoniacal copper etchant.

3. A process according to claim 1 wherein said spent ammoniacal copper etchant is preferably diluted with between 2 and 25 parts of said fresh ammoniacal copper etchant.

4. A process according to claim 1 wherein said fresh ammoniacal copper etchant contains 10–25% ammonium chloride and 20–40% ammonium hydroxide.

5. A process according to claim 1 wherein said aluminum metal includes aluminum and aluminum alloys.

6. A process according to claim 1 wherein said aluminum metal is in the form of granules, lumps, turnings, sheet, foil, or ingots.

7. A process according to claim 1 wherein the pH of said purified ammoniacal etchant solution is reconstituted by the addition of ammonia or ammonium hydroxide.

8. A process according to claim 1 wherein said specific gravity and chemical composition are reconstituted by suitable additions of a liquid concentrate to said separated ammoniacal etchant solution, to form reconstituted ammoniacal etchant.

9. A process according to claim 8 including reusing the reconstituted ammoniacal etchant for further copper etching.

* * * * *